US007522867B2

(12) United States Patent
Li et al.

(10) Patent No.: US 7,522,867 B2
(45) Date of Patent: Apr. 21, 2009

(54) TONER CARTRIDGE

(75) Inventors: Kuan-Tung Li, Taichung County (TW); Chun-Tien Liu, Taichung County (TW); Yueh-Chun Lee, Taichung County (TW)

(73) Assignee: General Plastic Industrial Co., Ltd. (TW)

( * ) Notice: Subject to any disclaimer, the term of this patent is extended or adjusted under 35 U.S.C. 154(b) by 32 days.

(21) Appl. No.: 11/783,805

(22) Filed: Apr. 12, 2007

(65) Prior Publication Data

US 2008/0138119 A1 Jun. 12, 2008

(51) Int. Cl.
*G03G 15/08* (2006.01)

(52) U.S. Cl. ..... 399/262

(58) Field of Classification Search ..... 399/262, 399/258, 260

See application file for complete search history.

(56) References Cited

U.S. PATENT DOCUMENTS 5,991,584 A * 11/1999 Meyer et al. ..... 399/262
6,038,422 A * 3/2000 Loewel ..... 399/262
2001/0008593 A1* 7/2001 Tsuji et al. ..... 399/262
2004/0052553 A1* 3/2004 Isomura et al. ..... 399/262

* cited by examiner

*Primary Examiner*—Quana M. Grainger
(74) *Attorney, Agent, or Firm*—Browdy and Neimark, P.L.L.C.

(57) ABSTRACT

A container for a toner cartridge includes a hollow main body defining a longitudinal central axis. The main body has a rear end, a front end with an opening, an inner circumference, a first section with a first guiding surface at the inner circumference, a second section with a second guiding surface at the inner circumference, a connecting section between the first section and the second section, and a guiding rib disposed at the inner circumference. The first guiding surface defines with the central axis a distance gradually increasing toward the opening and the second guiding surface defines with the central axis a distance gradually increasing toward the opening. The guiding rib extends from the first section to the second section via the connecting section and is unparallel to the central axis. The container has the advantages of being easy in manufacturing and hard to deform.

5 Claims, 5 Drawing Sheets

TONER CARTRIDGE

BACKGROUND OF THE INVENTION

1. Field of the Invention

The present invention relates generally to a toner cartridge and more specifically, to a container for a toner cartridge, which is easy to make and hard to deform.

2. Description of the Related Art

A conventional toner cartridge for an image forming apparatus, such as photocopier or printer, is horizontally installed in the image forming apparatus. The toner cartridge generally includes an elongated hollow container for accommodation of toner, and a toner-guiding member mounted on a front end of the container and provided with an outlet for output of the toner. In order to discharge the toner from the container to the image forming apparatus through the outlet, the container is provided at an inner circumference thereof with a plurality of spiral ribs. When the toner cartridge is rotated, the toner in the container will be forced by the spiral ribs to move from the inside of the container to the outside of the container through the outlet of the toner-guiding member.

Because the toner is forced to move by the ribs, the ribs need to be lined on the whole inner circumference of the container, such that a mold for the container can be difficulty made, resulting in high production costs. Further, since the ribs extend to a position close to the front end of the container, the front end of the container may easily deform due to the shrinkage of the plastics after the container is formed with plastic injection molding. In this situation, the toner-guiding member cannot be closely coupled to the container. Thus, it is a need to provide an improved container for the toner cartridge.

SUMMARY OF THE INVENTION

The present invention has been accomplished in view of the above noted circumstances. It is therefore one objective of the present invention to provide a container for a toner cartridge, which is easy to make.

It is another objective of the present invention to provide a container for a toner cartridge, which is hard to deform after it is made by plastic injection molding.

To achieve these objectives of the present invention, the container comprises a hollow main body defining a central axis. The main body has a closed rear end, a front end having an opening, a fist section near the rear end, a second section near the front end, a connecting section between the first section and the second section, and a guiding rib protruding from an inner circumference of the main body. The first section is provided at the inner circumference with a first guiding surface defining with the central axis a distance gradually increasing toward the opening of the front end. The second section is provided at the inner circumference with a second guiding surface defining the central axis a distance gradually increasing toward the opening of the front end. The guiding rib extends from the first section to the second section via the connecting section and is unparallel to the central axis.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The disclosed exemplary embodiments will become more fully understood from the detailed description given herein below and the accompanying drawings which are given by way of illustration only, and thus are not limitative of the present invention, and wherein.

DETAILED DESCRIPTION OF THE INVENTION

Figure 1:
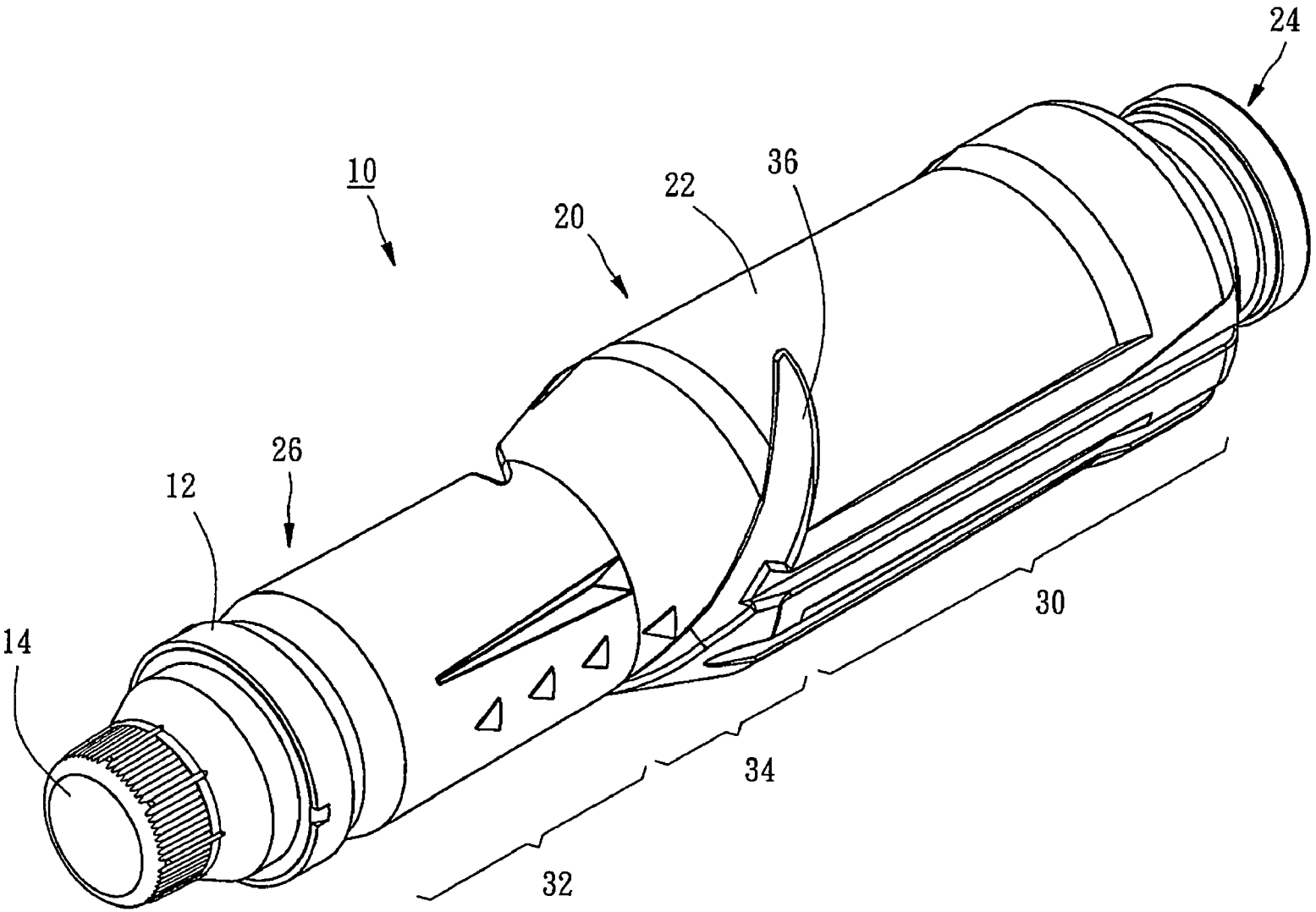
FIG. 1 is a perspective view of an exemplary embodiment of the present invention.
Figure 2:
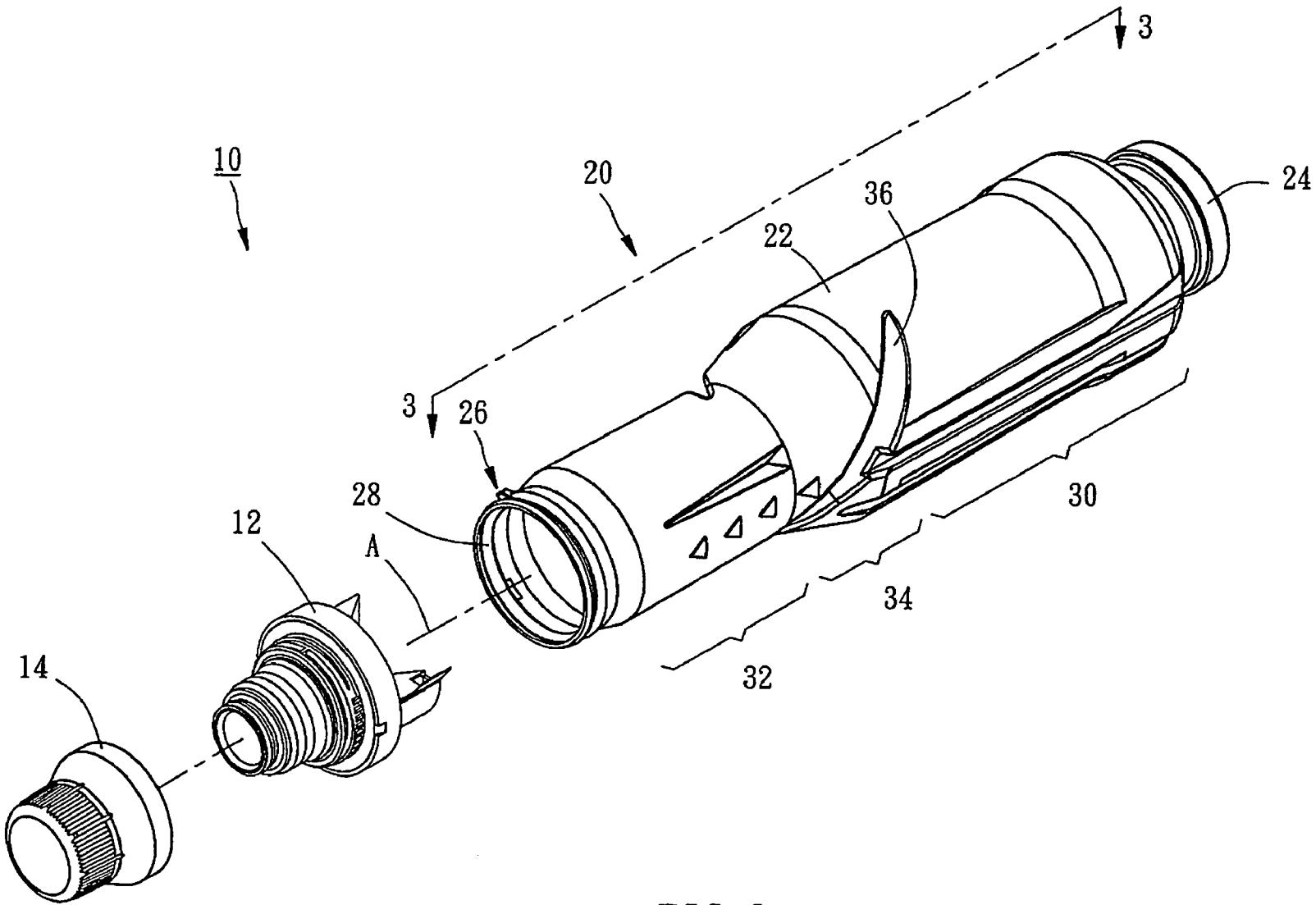
FIG. 2 is an exploded view of the exemplary embodiment of the present invention.

As shown in FIG. 1 and FIG. 2, a container 20 for a toner cartridge 10 in accordance with an exemplary embodiment of the present invention has an elongated hollow main body 22 having a closed rear end 24 and a front end 26 with an opening 28. The toner cartridge 10 includes a toner-guiding member 12 mounted on the front end 26 of the main body 22 and a cover 14 mounted on the toner-guiding member 12.

The elongated main body 22 extends along a central axis A thereof and defines along the axis A three sections, namely a first section 30 near the rear end 24, a second section 32 near the front end 26 and a connecting section 34 integrally connected between the first section 30 and the second section 32. The main body 22 has two guiding ribs 36 equiangularly protruding from an inner circumference thereof and suspending inside the main body 22.

Figure 3:
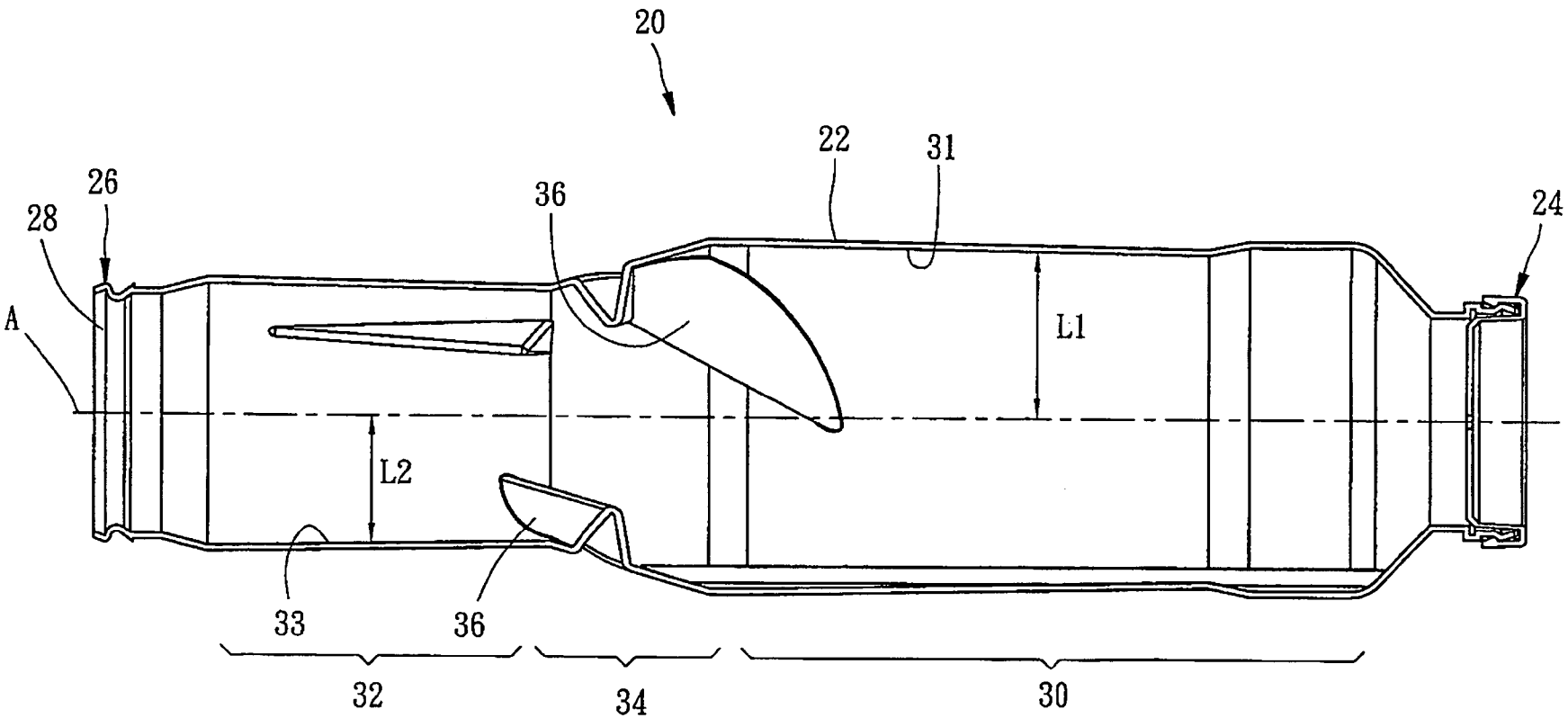
FIG. 3 is a sectional view taken along line 3-3 of FIG. 2.

As shown in FIG. 3, the first section 30 has a tube shape and the diameter of the first section 30 is larger than that of the second section 32. The first section 30 defines a first guiding surface 31 at the inner circumference thereof. The distance L1 between the first guiding surface 31 and the axis A, i.e. the radius measured from the inner circumference of the first section 31 to the central axis A, gradually increases from the rear end 24 toward the front end 26, so that the first guiding surface 31 is formed as a tapered surface, i.e. the first section 30 has a profile in the form of truncated conoid. The second section 32 has a truncated conoid profile with a second guiding surface 33 at the inner circumference thereof. The distance L2 between the second guiding surface 33 and the axis A gradually increases from the rear end 24 toward the front end 26, so that the second guiding surface 33 is formed as a tapered surface.

Figure 4:
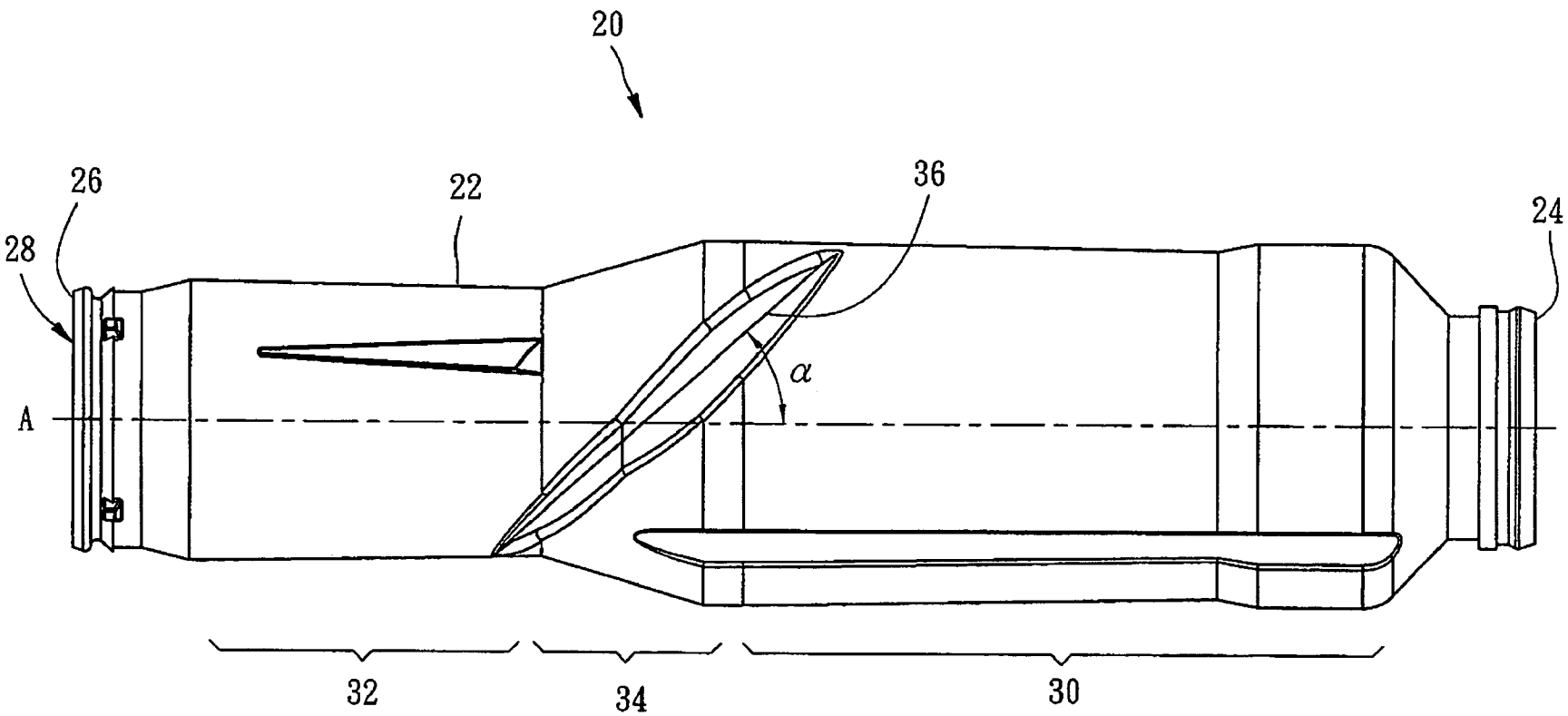
FIG. 4 is a front view of the exemplary embodiment of the present invention.

The connecting section 34 has a truncated conoid profile with its radius gradually decreasing toward the front end. That is, the crosssection area of the connecting section 34 gradually decreases from one end connected with the first section 30 to the other end connected with the second section 32. The two ribs 36 respectively extend from the first section 30 to the second section 32 via the connecting section 34. As shown in FIG. 4, an included angle $\alpha$ about 40 degrees is defined between each guiding rib 36 and the axis A.

Figure 5:
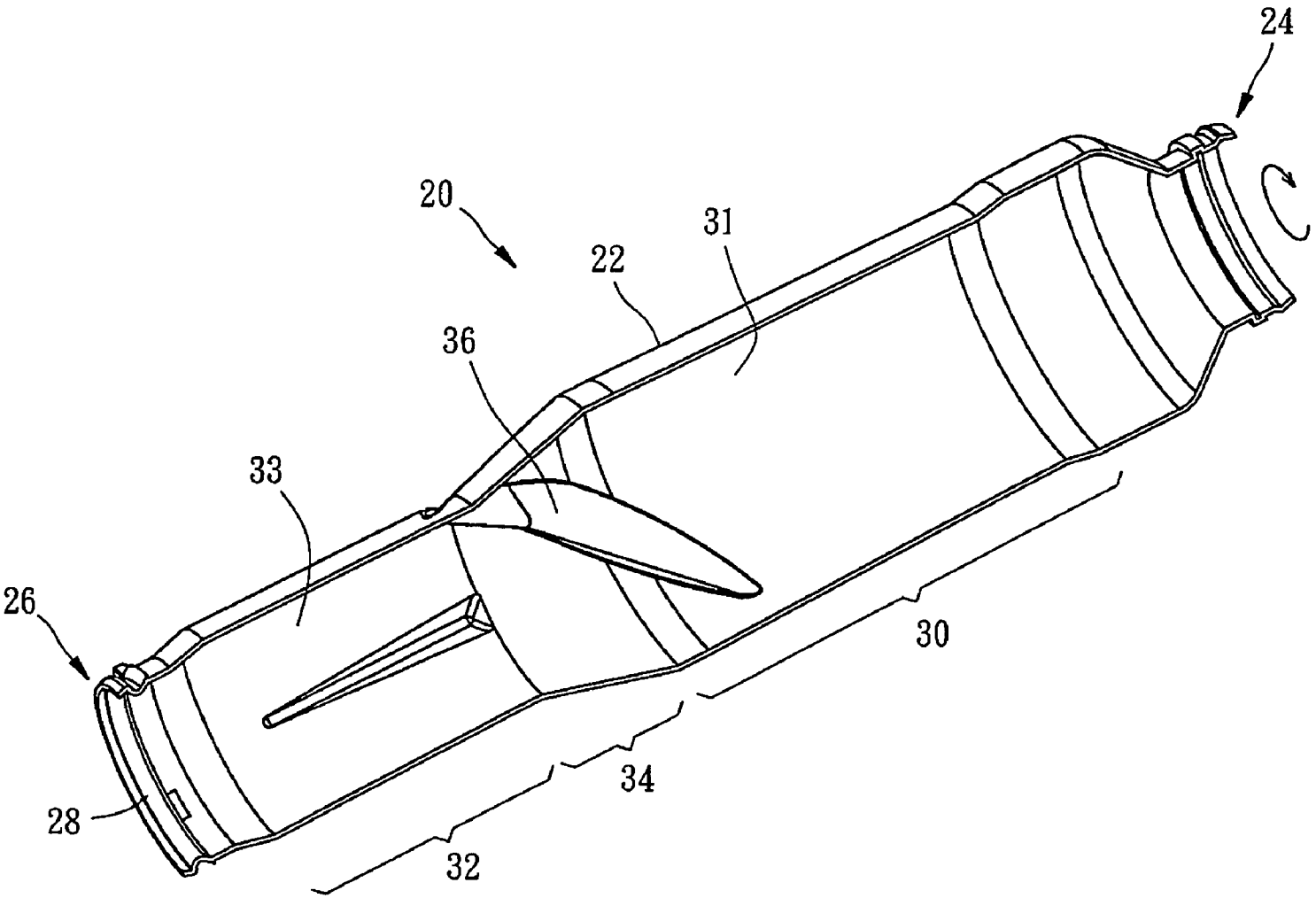
FIG. 5 is a sectional view of a part of the exemplary embodiment of the present invention.

When the toner cartridge 10 is horizontally installed in an image forming apparatus and rotated about the axis A, the toner (not shown) in the container 20 will naturally move by gravity from a rear end of the first section 30 toward a front end of the first section 30, which is lower in elevation than the rear end thereof, and then the toner will be forced by the guiding ribs 36, which are rotated in a direction denoted by the arrow in FIG. 5, to move from the connecting section 34 to the second section 32, and then the toner in the second section 32 will naturally move by gravity from a rear end of the second section 32 toward a front end of the second section 32, which is lower in elevation than the rear end thereof. In other words, the toner in the container 20 can be gradually moved to the opening 28 by rotating the toner cartridge 10 for enabling the toner to be eventually discharged out of the toner cartridge 10 by the toner-guiding member 12.

The container 20 of the present invention has a simple shape, so that a mold for the container 20 is easy to make, resulting in cost reduction. Moreover, because the ribs 36 are located at about a middle of the container 20, the shape around the opening 28 of the container 20 is simple, so that the front end 26 of the container 20 is hard to deform when the plastic materials are shrunk after the container 20 is formed with plastic injection molding. Thus, the toner-guiding member 12 can be closely coupled to the undeformed container 20, thereby improving the defect of the prior art and achieving the objectives of the present invention.

In this embodiment, the outer circumference of the main body 22 is partially inwardly depressed so as to form the two embossed guiding ribs 36 suspending inside the main body 22. However, in actual fabrication, the guiding ribs 36 can be made directly protruding from the inner circumference of the main body 22. In addition, the number of the guiding ribs is not limited to the above-mentioned embodiment and the included angle between each guiding rib 36 and the axis A is changeable subject to the actual need as long as the guiding rib 36 is not parallel to the axis A.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A container for a toner cartridge, the container comprising:

an elongated hollow main body defining a central axis, the main body having a closed rear end and a front end with an opening;

wherein the improvement is characterized in that the main body includes a first section near the rear end, a second section near the front end, a connecting section between the first section and the second section, and a guiding rib disposed at an inner circumference of the main body and extending from the first section to the second section via the connecting section in such a manner that the guiding rib and the central axis are unparallel;

wherein the first section has a first guiding surface having a first diameter which gradually increases along the central axis toward the opening and the second section has a second guiding surface having a second diameter which increases along the central axis gradually toward the opening.

2. The container as claimed in claim 1, wherein the first guiding surface is a tapered surface.

3. The container as claimed in claim 1, wherein the second guiding surface is a tapered surface.

4. The container as claimed in claim 1, wherein the cross-section area of the connecting section gradually decreases toward the opening.

5. The container as claimed in claim 1, wherein the guiding rib defines with the central axis an included angle about 40 degrees.

* * * * *